United States Patent [19]

Huber

[11] Patent Number: 4,658,183

[45] Date of Patent: Apr. 14, 1987

[54] TRAVELING-WAVE TUBE

[75] Inventor: Günther Huber, Munich, Fed. Rep. of Germany

[73] Assignee: Siemens Aktiengesellschaft, Berlin and Munich, Fed. Rep. of Germany

[21] Appl. No.: 592,921

[22] Filed: Mar. 23, 1984

[30] Foreign Application Priority Data

Mar. 31, 1983 [DE] Fed. Rep. of Germany ..... 3311910

[51] Int. Cl.[4] ..... H01J 25/34

[52] U.S. Cl. ..... 315/3.5; 315/39.53; 333/26; 333/32

[58] Field of Search ..... 333/25, 26, 32, 34; 315/3.5, 39.53

[56] References Cited

U.S. PATENT DOCUMENTS

| | | | |
|---|---|---|---|
| 2,936,395 | 5/1960 | Everhart | 315/3.5 |
| 3,478,282 | 11/1969 | Smith | 333/34 X |
| 3,532,926 | 10/1970 | Winslow | 315/3.5 |
| 4,004,180 | 1/1977 | Gross | 315/39.53 |
| 4,333,038 | 6/1982 | Sato | 315/3.5 |

*Primary Examiner*—Saxfield Chatmon

*Attorney, Agent, or Firm*—Herbert L. Lerner; Laurence A. Greenberg

[57] ABSTRACT

A traveling-wave tube, including a delay line having two end surfaces, a spatially periodic permanent magnet system surrounding the delay line for the bunched guidance of an electron beam, the delay line having line cells disposed in tandem, each of the cells having an electron beam passage opening formed therein and adjacent partitions separating the cells with a given mutual spacing, each of the partitions having at least one coupling opening formed therein extended substantially in circumferential direction, a ridgeless rectangular waveguide coupled to at least one of the end surfaces of the delay line and protruding away from the delay line substantially at right angles to the axis of the delay line, the waveguide having a location of smallest reflection, a wide side facing away from the delay line extended substantially perpendicular to the longitudinal axis of the delay line and at least one narrow side being steadily tapered toward the delay line down to substantially the given spacing of the adjacent partitions, and a short-circuit slider disposed below the waveguide, includes a hollow-cylindrical matching element disposed at the wide side of the waveguide facing away from the delay line, the hollow-cylindrical matching element having a fine thread screwed to the location of least reflection and fixed and soldered to the waveguide.

8 Claims, 1 Drawing Figure

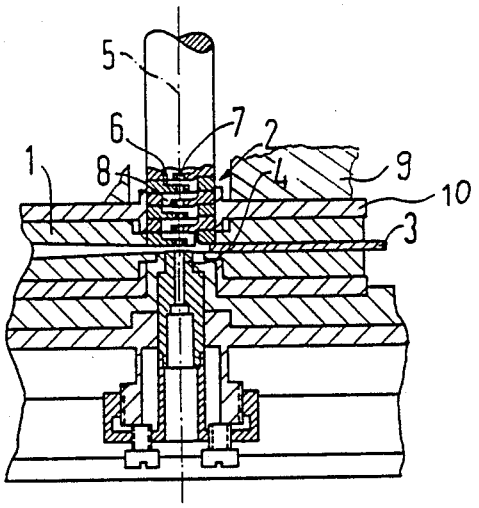
5
6
7
2
1
8
4
9
10
3

TRAVELING-WAVE TUBE

The invention relates to a traveling-wave tube, including a spatially periodic permanent magnet system for the bunched guidance of an electron beam, a delay line surrounded by the magnet system, the delay line having line cells in tandem, each of which being separated by an electron beam passage opening and by partitions having at least one coupling opening extending substantially in the circumferential direction, the delay line being coupled at least at one of its two end faces to a ridgeless rectangular waveguide which leads away from the axis of the line substantially at right angles, the waveguide having a broad side extended perpendicularly to the longitudinal axis of the delay line, and a narrow side steadily tapered toward the delay line to approximately the spacing of adjacent partitions, a short-circuit slider disposed in the bottom of the rectangular waveguide, and a hollow-cylindrical matching element in the broad side of the rectangular waveguide opposite the delay line.

Such a traveling-wave tube, particularly a heavy-duty traveling-wave tube, is known from German Published, Non-Prosecuted Application DE-OS No. 29 34 556.

German Patent DE-PS No. 25 25 598 corresponding to U.S. Pat. No. 4,004,180 and to British Pat. No. 1,552,148, discloses a traveling-wave tube in which the broad or wide side of the rectangular waveguide is narrowed down in sections toward the delay line ahead of the axis of the line, forming an aperture formed of two aperture projections. However, this structure has the disadvantage of having aperture projections which are milled into the rectangular waveguide and subsequent correction of the aperture adjustment, which is usually necessary, is therefore not possible.

It is accordingly an object of the invention to provide a traveling-wave tube which overcomes the hereinafore-mentioned disadvantages of the heretofore-known devices of this general type, and to permit a continuous adjustment of a matching element of the delay line of a traveling-wave tube for minimum reflection and for fixing in this position.

With the foregoing and other objects in view there is provided, in accordance with the invention, a traveling-wave tube, including a delay line having two end surfaces, a spatially periodic permanent magnet system surrounding the delay line for the bunched guidance of an electron beam, the delay line having line cells disposed in tandem, each of the cells having an electron beam passage opening formed therein separation the cells and adjacent partitions separating the cells with a given mutual spacing, each of the partitions having at least one coupling opening formed therein extended substantially in circumferential direction, a ridgeless rectangular waveguide coupled to at least one of the end surfaces of the delay line and protruding away from the axis of the delay line substantially at right angles to the axis of the delay line, the waveguide having a location of smallest reflection, a wide side facing away from the delay line extending substantially perpendicular to the longitudinal axis of the delay line and at least one narrow side being steadily tapered toward the delay line down to substantially the given spacing of the adjacent partitions, and a short-circuit slider disposed below or in the bottom of the waveguide, comprising a hollow-cylindrical matching element disposed at or in the wide side of the waveguide running perpendicularly toward the delay line facing away from or opposite the delay line, the hollow cylindrical matching element having a fine thread screwed to the location of least reflection and fixed and soldered to the waveguide.

In accordance with another feature if the invention, the rectangular waveguide and the matching element are formed of copper.

In accordance with a further feature of the invention, the short-circuit slider is formed of a copper-nickel-manganese alloy, i.e. a resistance material.

In accordance with a concomitant feature of the invention, the rectangular waveguide has an input side, the matching element is disposed at the input side, and the matching element has a molybdenum insert for avoiding thermal stresses.

The advantage of the invention is that matching for minimum reflection which has heretofore been carried out iteratively and in a time-consuming manner by exchanging spacer rings, is improved by the provision that the matching element is provided with a fine thread. The matching element can therefore be moved steplessly in the waveguide in the axial direction. By simply turning-in the matching element, the position with minimum reflection can be very quickly determined. The element is fixed by means of a clamping screw. After subsequent soldering, in which the matching element is simultaneously soldered, motion simulation can be dispesed with and the desired configuration can be provided.

Other features which are considered as characteristic for the invention are set forth in the appended claims.

Although the invention is illustrated and described herein as embodied in a traveling-wave tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a fragmentary, diagrammatic cross-sectional view, partly broken away, through the region near the line of the coupling waveguide.

Referring now to the FIGURE of the drawing in detail, in which parts which do not contribute to an understanding of the invention have not been designated with reference numerals in the FIGURE or have been omitted, there is seen a region of a traveling-wave tube which is close to the line of the coupling waveguide and is formed of a ridgeless rectangular copper waveguide 1, which is terminated at the bottom thereof by a short-circuit slider 3 formed of resistance material, such as a copper-nickel-manganese alloy. In this embodiment, a delay line 2 is provided which is formed of a stack of identical washers 6 representing tandem line cells. Each washer has a circular rib or partition, a central hole in the form of an electron-beam passage opening 7 as well as a coupling opening 8 in the form of a circular segment in the partition extended in circumferential direction. Each washer is rotated through 180° relative to the preceding washer. In this manner, a delay line having coupled cavities with a backward-traveling direct wave is produced. The waveguide leads away from the axis of the delay line substantially at right angles. The delay line 2 is surrounded by a metallic vacuum envelope and the vacuum envelope is in turn surrounded by a spatially periodic permanent magnet system 9 disposed on a spacer 10 for the bunched guidance of an electron beam. At the height or level of the longitudinal axis 5 of the delay line 2, a hollow-cylindrical copper matching element 4 provided with a fine thread is screwed to the wide side of the rectangular waveguide 1 at the location of smallest reflection opposite the delay line 2, for coupling the HF energy in and out. The matching element 4 is fixed and soldered to the waveguide 1 after being screwed in and fixed with a clamping screw. The wide side of the waveguide is substantially perpendicular to the axis 5 and the narrow side thereof is steadily tapered toward the delay line to substantially the spacing of adjacent partitions. The matching element is disposed at the input side and has a molybdenum insert for avoiding thermal overstress.

I claim:

1. In a traveling-wave tube, including a delay line having two end surfaces, a spatially periodic permanent magnet system surrounding the delay line for the bunched guidance of an electron beam, the delay line having line cells disposed in tandem, each of the cells having an electron beam passage opening formed therein and adjacent partitions separating the cells with a given mutual spacing, each of the partitions having at least one coupling opening formed therein extended substantially in circumferential direction, a ridgeless rectangular waveguide coupled to at least one of the end surfaces of the delay line and protruding away from the delay line substantially at right angles to the axis of the delay line, the waveguide having a location of smallest reflection, a wide side facing away from the delay line extended substantially perpendicular to the longitudinal axis of the delay line and at least one narrow side being steadily tapered toward the delay line down to substantially the given spacing of the adjacent partitions, and a short-circuit slider disposed below the waveguide, the improvement comprising a hollow-cylindrical matching element fixed and soldered to the wide side of the waveguide facing away from the delay line, said hollow-cylindrical matching element including means for infinitely adjusting the position of said matching element for minimum reflection before soldering, said adjusting means being a fine thread screwed to the location of smallest reflection of the waveguide.

2. Traveling-wave tube, comprising a delay line having two end surfaces, the delay line having line cells disposed in tandem, each of said cells having an electron beam passage opening formed therein and adjacent partitions separating said cells with a given mutual spacing, each of said partitions having at least one coupling opening formed therein extended substantially in circumferential direction, a ridgeless rectangular waveguide coupled to at least one of said end surfaces of said delay line and protruding away from said delay line substantially at right angles to the axis of said delay line, said waveguide having a location of smallest reflection, a wide side facing away from said delay line extended substantially perpendicular to the longitudinal axis of said delay line and at least one narrow side being steadily tapered toward said delay line down to substantially the given spacing of said adjacent partitions, a short-circuit slider disposed below said waveguide, and a hollow-cylindrical matching element fixed and soldered to said wide side of said waveguide facing away from said delay line, said hollow-cylindrical matching element including means for infinitely adjusting the position of said matching element for minimum reflection before soldering, said adjusting means being a fine thread screwed to the location of smallest reflection of said waveguide.

3. Traveling-wave tube according to claim 1, wherein the rectangular waveguide and said matching element are formed of copper.

4. Traveling-wave tube according to claim 2, wherein the rectangular waveguide and said matching element are formed of copper.

5. Traveling-wave tube according to claim 1, wherein the short-circuit slider is formed of a copper-nickel-manganese alloy.

6. Traveling-wave tube according to claim 2, wherein the short-circuit slider is formed of a copper-nickel-manganese alloy.

7. Traveling-wave tube according to claim 1, wherein the rectangular-wave guide has an input side, said matching element is disposed at the input side, and said matching element has a molybdenum insert for avoiding thermal overstresses.

8. Traveling-wave tube according to claim 2, wherein the rectangular-wave guide has an input side, said matching element is disposed at the input side, and said matching element has a molybdenum insert for avoiding thermal overstresses.

* * * * *